United States Patent [19]

Krasser

[11] Patent Number: 4,573,031

[45] Date of Patent: Feb. 25, 1986

[54] PUSH BUTTON-ACTUATED OVERLOAD PROTECTIVE CIRCUIT BREAKER

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 667,223

[22] Filed: Nov. 1, 1984

[30] Foreign Application Priority Data

Nov. 22, 1983 [DE] Fed. Rep. of Germany ..... 3342144

[51] Int. Cl.[4] ..... H01H 71/16

[52] U.S. Cl. ..... 337/68; 337/66

[58] Field of Search ..... 337/68, 66, 62

[56] References Cited

U.S. PATENT DOCUMENTS 4,123,737 10/1978 Hoagland, Jr. ..... 337/68

4,347,494 10/1981 Krasser ..... 337/66

FOREIGN PATENT DOCUMENTS 3115435 11/1982 Fed. Rep. of Germany .

*Primary Examiner*—Harold Broome

*Attorney, Agent, or Firm*—Spencer & Frank

[57] ABSTRACT

A push button-actuated overload protective circuit breaker with bimetal cutout comprises a housing between the sidewalls of which two contact segments are held in position, and a push button and a pressure spring associated therewith are guided for longitudinal displacement therebetween. The ends of the contact elements which protrude from the housing are devised as plug-in prongs arranged in parallel with each other. In order to provide a circuit breaker of such small size that it can be plugged into a flat-shape fuse female plug socket, the contact elements are provided in a middle zone thereof, each with a step-like bend the height of which corresponds to about half the height of the interior space in the housing. The bent contact ends then come to rest against the opposite internal surfaces of the housing sidewalls.

At one of the contact ends of a first contact element there is fastened a bimetal snap spring with one side thereof and extends transverse to the direction in which the contact elements extend. This bimetal snap spring has a slewable end which overlaps the second contact element and is biassed into contact with the latter when in rest position. The push button is provided at its inner end with a separating wall which is adapted for sliding between the slewable end of the bimetal spring and the contact end of the second contact element when the circuit breaker is released.

14 Claims, 7 Drawing Figures

PUSH BUTTON-ACTUATED OVERLOAD PROTECTIVE CIRCUIT BREAKER

BACKGROUND OF THE INVENTION

This invention relates to a push button-actuated overload (excessive current) protective circuit breaker with bimetal cutoff comprising a housing having sidewalls between which two contact elements are held in position, and a push button as well as a pressure spring cooperating therewith are guided for longitudinal displacement; and the ends of the contact elements protruding from the housing are tongue-shaped blades or prongs, as male plug parts.

The housing of a known excess-current protective circuit breaker of this type is of narrowly built structure and has two opposite sidewalls (broad sides) between which the aforesaid contact elements are lodged and the aforesaid pressure button and the compression spring associated therewith are longitudinally displaceably guided. The cutoff or release of the known switch is effected by bimetal means. A known circuit breaker of this type has been described in U.S. Pat. No. 4,347,494 to Fritz Krasser granted on Aug. 31, 1982.

The embodiment of the switch unit of the known circuit breaker is relatively complicated and voluminous, so that it is not possible to manufacture it of small size and inexpensively.

OBJECTS AND SUMMARY OF THE INVENTION

It is an object of the invention to provide a circuit breaker of the above-described kind which is of such small size that it can be plugged-in in a flat-shape fuse female plug such as is known from a flat-shaped fuse described, for instance, in German Offenlegungsschrift No. 31 15 435, without occupying substantially more space than the said flat-shaped fuse.

This object and others which will become apparent from the further description of the invention hereinafter, are attained by providing an overload protective circuit breaker of the initially described type wherein each of the contact elements is provided in its central region with a step-like bend, the height of which step corresponds at least approximately to half the height of the interior space in the housing, and the said contact elements rest, with their bent-off mounting end portions inside the housing, on the opposite inner wall surfaces of the latter; and the circuit breaker comprises a bimetal snap disc being fastened on one side thereof to the mounting end portion, located inside the housing, of a first one of the two contact elements, the said bimetal snap disc extending through the housing transverse to the longitudinal extension of the contact elements, and having a fastening end and, opposite the latter, a slewable end which overlaps the mounting end portion of the second contact element, and engages with bias the said mounting end portion of the second contact element, when the circuit breaker is in unactuated, closed position; and the said push button comprises, attached to a region thereof located inside the housing, a separating wall projecting laterally from one side of the said push button inner end, and the said dividing wall comprises an edge facing toward the push button and engaging, with tensioning of the pressure spring, a lateral nose or nipple of the opposite contact terminal which nose projects toward the said edge when the bimetal snap disc is in non-excited state, while, when the bimetal snap disc is excited and thus bent upwardly, the said separating wall will slide, urged by the pressure spring, between the slewable end of the snap disc and the contact nipple on the mounting end portion of the second contact element.

This novel structure of the circuit breaker according to the invention has a number of advantages. First of all, due to the fact that it requires only five parts making up the switch unit, namely, the two contact elements, the bimetal snap disc, the pressure button inclusive of the separating wall, and, finally the pressure spring, the unit can be lodged in a space of minimum size. All parts of the switch unit are destined to fulfill several tasks. Thus, the bimetal snap disc does not only serve as the active releasing (circuit breaking) element, but additionally also as an arresting member for the separating wall of the push button. The latter wall serves, besides its arresting function, also for ensuring a safe mutual insulation of the two switch contactors while they are in open position. The compression spring is responsible for providing a satisfactory locking pressure as well as for the shifting of the actuating button to the "out" position.

Apart from the advantageous reduction of the number of parts and their sizes to a minimum, all building elements of the switch unit can be assembled and introduced into the circuit breaker housing in a very simple manner, thus permitting a full automation of the manufacturing process. In this connection, it must be taken into account that the circuit breakers in question are to be used, apart from other fields of application, in the automobile industry, and must thus be typical mass-produced articles.

The assembly of the circuit breaker according to the invention can be carried out in a particularly simple manner and fully automatically, when the housing comprises two identical half shells being joined to each other in parallel position, the half shells have substantially U-shaped cross sections, and the contact elements consist of substantially identical punched, step-like bent parts.

By simply inserting the switch parts into one of the two shell halves, e.g., the lower one, and subsequently fastening the second half shell over the first one as a lid, the assembly of the circuit breaker is carried out and terminated very quickly. Keeping stores of the parts is simplified by the above-mentioned identity of some of them. The breadth of the bimetal snap disc in the direction of the longitudinal extension of the switch preferably corresponds at least approximately to its length in a direction transverse to the said longitudinal switch extension.

This ensures that the bimetal snap disc will not become warped under the pressure of the compression spring which urges the push button in a direction out of the housing. Moreover, the especially broad bimetal snap disc provides a pronounced snap effect, which ensures a particularly well-defined switching behavior of the circuit breaker of the simple structure in accordance with the invention.

The separating wall is preferably somewhat L-shaped and has a first and second L-leg, while the compression spring comprises a guiding pin extending thereinto, with the first L-leg extending substantially parallel with, and the second L-leg at a right angle to, the said guiding pin. This preferred configuration of the separating wall assists in guiding the push button and ensures in particular that the push button which is one-sidedly urged to tilt while in engaged position, will not be caught during its circuit-breaking or opening movement. As the compression spring surrounds a guiding pin which is arranged parallely besides the separating wall, the structural height of the compression spring-/push button unit in the direction of axial push button shifting movement can be kept at a minimum, which leads in turn to a reduction in the total height of the circuit breaker in plug-in direction; thereby, the circuit breaker according to the invention is not much higher than the conventional plug-in meltable fuses.

A further reduction in the structural height as well as improvements in the guidance properties of the push button are attained by providing the push button with a groove outside its central portion but in its actuating end portion, which groove is engaged by the upper rim of the bimetal snap disc when the push button is depressed so that the depressed push button considerably overlaps with the relatively broad bimetal snap disc.

The half shells of the housing can be provided with two guiding grooves facing toward one another which serve for guiding the compression spring. Moreover, the half shells of the housing can be provided on one side with inlay recesses for receiving therein the mounting end portions of the contact elements. These preferred features provide a particularly good and safe positioning of the elements being introduced into the housing. A particularly firm hold of the male plug prongs, which are frequently subject to twisting and bending stresses when being plugged in, is provided when these prongs are at least partly covered by a segment of the casing having corresponding inserting grooves. Moreover, the housing may have a segment on the side of the prongs which bears fastening pins that are adapted for engaging in round holes provided in the male plug prongs to define their final assembling position.

By providing additional holding elements being preferably integral with the shell halves, the male plug prongs protruding from the housing of the circuit breaker according to the invention can be further supported by having these holding elements holding the entire breaker on a fuse base socket. To this end, two spring-biassed hooks are provided in each of the two narrow sides of each housing segment covering a rear portion of each of the two prongs, with the back sides of the two hooks being at an adequate distance from one another permitting resiliently engaging the above-mentioned socket.

Preferably, a transversely stiffening element of electrically insulating material can be inserted between the two contact elements, which stiffening or reinforcing element can be devised as an elongated small plate extending transversely to the longitudinal extension of the prongs. This small plate preferably extends across the two contact elements in the regions of their steplike bends with diagonally opposite recesses, and preferably has a plate face turned toward the push button, on which plate face one end of the compression spring is supported. This provides an additional stiffening of the entire housing in transverse direction as well as a durable fixing of the distance between the two contact elements.

BRIEF DESCRIPTION OF THE DRAWINGS

Further objects and advantages of the circuit breaker according to the invention will become apparent from the following description thereof in connection with the accompanying drawings illustrating a preferred embodiment thereof. In the drawings.

FIG. 7 is an exploded view of the embodiment shown in FIGS. 1 to 6.

DETAILED DESCRIPTION OF THE EMBODIMENT SHOWN IN THE DRAWINGS

Figure 1:
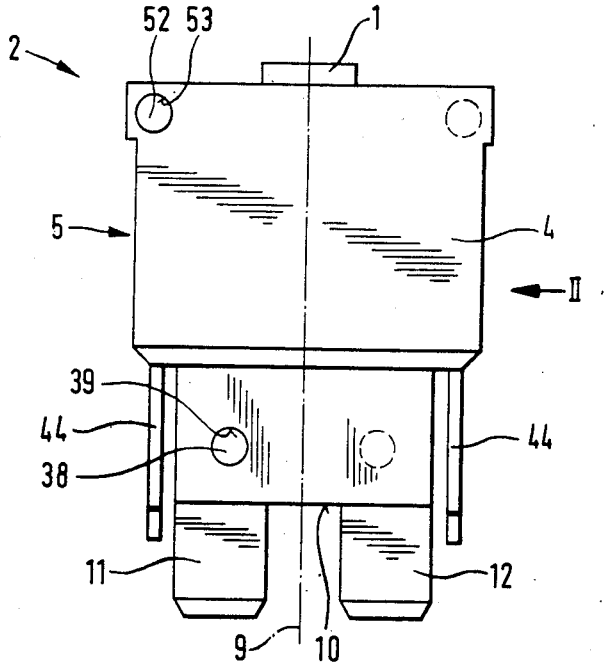
FIG. 1 shows a top view of a preferred embodiment of the circuit breaker according to the invention, on to a broad side thereof.
Figure 2:
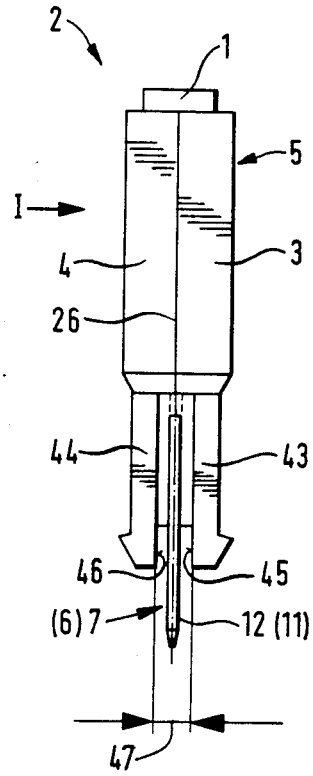
FIG. 2 is a lateral view of the embodiment shown in FIG. 1 on to a narrow side thereof.
Figure 3:
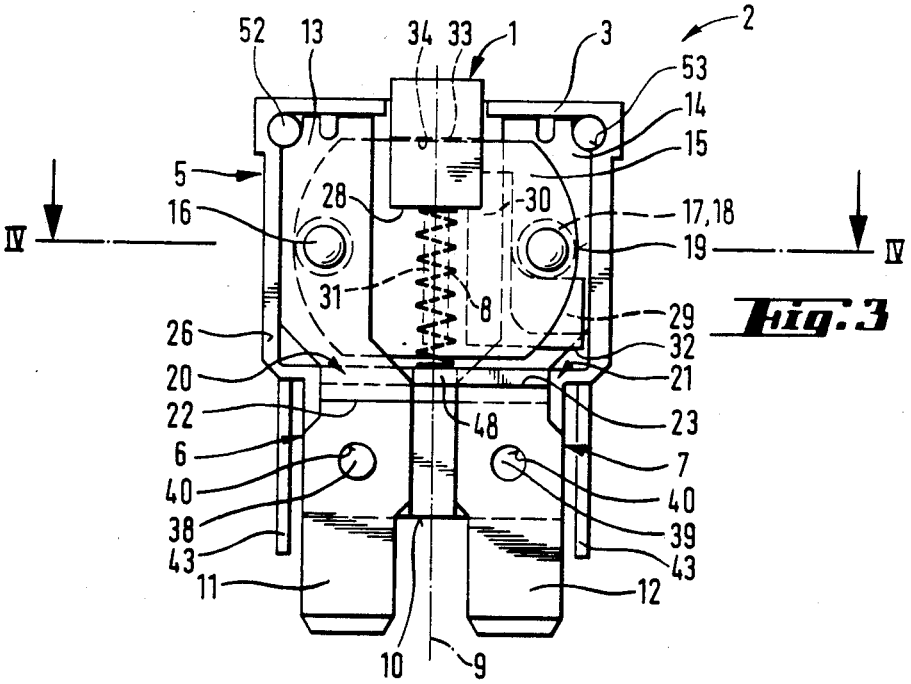
FIG. 3 is a similar view as FIG. 1, but with one of the two shell halves removed.
Figure 4:
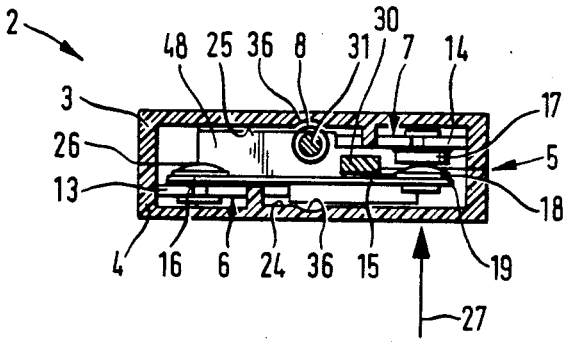
FIG. 4 is a sectional view taken in plane indicated by IV—IV in FIG. 3.
Figure 5:
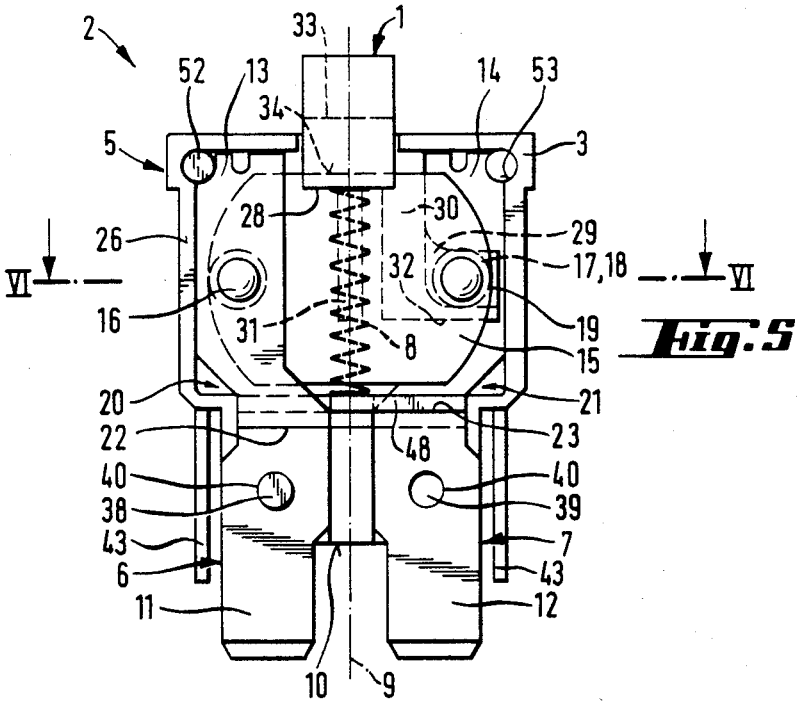
FIG. 5 is a view similar to FIG. 3, however, with the parts in circuit-breaking position.
Figure 6:
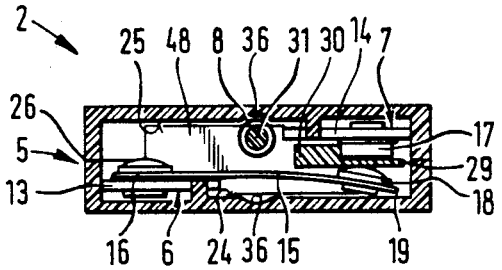
FIG. 6 is a sectional view similar to that of FIG. 4, but with the parts in circuit-breaking position.
Figure 1:
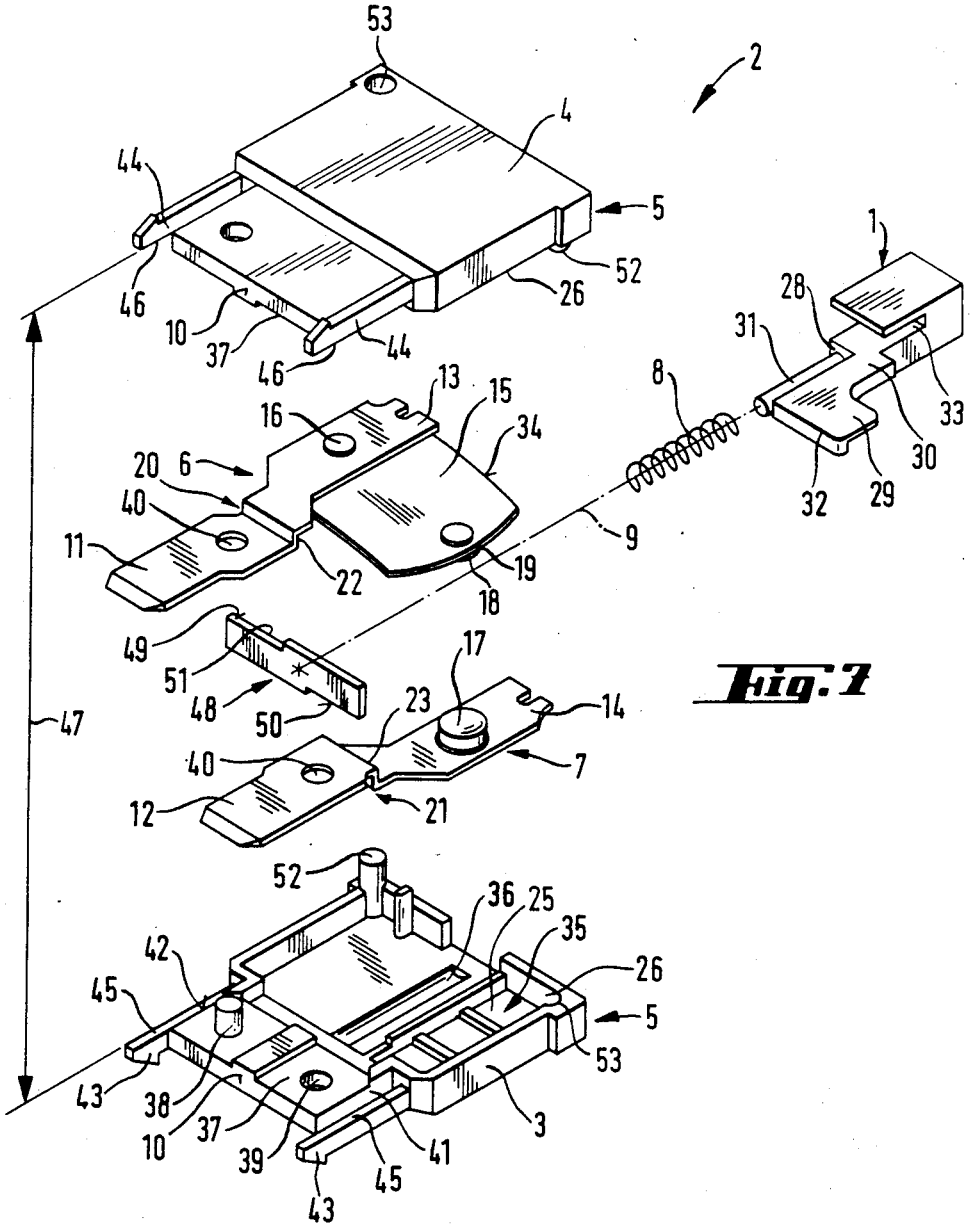

The excess-current protective circuit breaker 2, hereinafter referred to as "the circuit breaker", can be actuated by a push button 1 and comprises a housing 5 consisting of two shell halves 3 and 4 which are made of electrically insulating material and are placed one upon the other to form the complete housing. In the interior of the housing 5 there are held in position two contact elements 6 and 7, and the push button 1 as well as a compression spring 8 are lodged in the housing 5 for axial displacement in a longitudinal direction indicated by reference numeral 9. The free ends of the two contact elements 6 and 7 which protrude from the underside 10 of the housing 5 are devised as plug-in prongs 11 and 12 extending in parallel with each other in one and the same plane. At the opposite end portions 13 and 14, the contact elements 6 and 7 are devised as mounting ends; to the end portion 13 of the contact element 6 there is firmly attached, via its fastening side 16, a bimetal element which is devised as a bimetal snap disc 15, while the opposite contact element 7 bears a nipple-shaped contact terminal 17 which is adapted to make or break contact with an equally nipple-shaped counter contact post 18. The latter is borne by the slewable end 19 of the bimetal snap disc 15.

In their central regions 20 and 21, the two contact elements 6 and 7 are provided with stepped bends 22 and 23, respectively, which are of Z-shaped profile; these bends cause the inner end portions 13 and 14 of the contact elements 6 and 7, respectively, to come to rest against the inner surfaces 24 and 25 of the respective shell halves 3 and 4, when the contact elements 6 and 7 are mounted in the casing 5 in the same plane which is defined by the separating joint 26 between the two shell halves 3 and 4.

The bimetal snap disc 15 is attached inside the housing via its fastening end 16 to the end portion 13 of the contact element 6 in such a manner that, in the non-excited state, its counter terminal 18 makes contact with the contact nipple 17 of the contact element 7 with bias in the direction of the arrow 27, so that the contact line is closed.

In the region of its end 28 inside the housing 5, the push button 1 is provided with a separating wall 29 which protrudes laterally from the push button body on one side of the latter and extends at least approximately in the plane of the separating joint 26; when the bimetal snap disc 15 is nonexcited, this separating wall 29 makes contact from below, with bias by the compression spring 8, with the counter contact nipple 18 of the bimetal snap disc 15. When the bimetal snap disc 15 is excited and therefore upwardly bent, pressure of the compression spring 8 causes the separating wall 29 to snap between the contact nipples 17 and 18 which have just broken contact, and thus assures a safe electrical separation of the two contactors.

As the bimetal snap disc 15 is subjected to the pressure of the compression spring 8 acting laterally on the same when the circuit breaker is switched on, it is made, for reasons of stability, so broad in longitudinal direction 9, as to be approximately of the same dimension as its length between its fastening end 16 and its slewable end 19.

The separating wall 29 is substantially L-shaped, with a first L-leg 30 extending substantially parallel with a guiding pin 31 which plunges into the compression spring 8, while the other L-leg 32 forms approximately a right angle with the first L-leg and constitutes the laterally extending portion of the separating wall 29.

The push button 1 is furthermore provided with a groove or transverse recess 33 open toward the central region thereof and extending, parallel with the plane of the separating joint 26, into the external actuating portion of the push button which protrudes from the housing 5. Into this groove 33 projects the upper rim 34, facing toward the push button 1, of the bimetal snap disc 15, at least while the circuit breaker is switched on.

In order to simplify the assembly of the circuit breaker according to the invention, and to guide the moving parts thereof in a manner guaranteeing their safe functioning, the half shells 3 and 4 of the housing 5 are provided with recesses 35 for receiving the contact elements 6 and 7 therein, as well as with guiding grooves 36 which extend in the longitudinal direction 9. The compression spring 8 is lodged in one of the guiding grooves 36 and is guided on the same during its longitudinal expanding and contracting movements. The pressure spring 8 is supported with its one end facing away from the actuating portion of push button 1, on a flat face 51, turned toward the push button, of a transversely extending stiffening element 48 made of elastically insulating material, which stiffening element is held in position between the two contact elements 6 and 7 and has a top rim and a lower rim for abutting therewith, and cutaway sections in diagonally opposite regions of the said top rim and lower rim for receiving therein the underside and the upper side, respectively, of the said first and second contact elements, in the regions of the bends 22 and 23 thereof, thus distancing these contact elements from each other. A lower housing segment 37 in each of the half shells covers the upper ends of the plug-in prongs 11 and 12, inserted in between the two half shells, on both sides thereof, and secures them in the housing. The housing segments 37 are provided with positioning pins 38 and corresponding recesses 39, respectively, which are arranged in such a manner that the pins 38 engage the corresponding recesses 39 when the identical half shells 3 and 4 are placed upon one another in the final assembled position. The pins 38 will then pass through round holes 40 which are provided in the prong portions 11 and 12 of the contact elements 6 and 7. At the narrow side faces 41 and 42 of each of the housing segments 37, there are provided pairs of spring-loaded hooks 43 and 44, respectively; the backsides 45 and 46 of each pair of hooks face toward each other at the distance 47 from each other, which permits a resilient deflection of the hooks.

Likewise, there are provided at the upper end of the switch unit 2 which comprises the push button 1, holding pins 24 on one of the half shells 3 and 4, and corresponding recesses 25 on the other half shell, for positioning and fastening the half shells together.

I claim:

1. A push-button actuated overload circuit breaker with bimetal cutoff, comprising (a) a housing having sidewalls bearing internal surfaces and an interior space therein;

(b) a first and a second contact element being held in position between said sidewalls, (c) a push button and (d) a pressure spring cooperating with said push button, said push button being guided in said housing for longitudinal displacement therein, said contact elements having each a prong-shaped end, protruding from said housing, said prong-shaped ends being arranged in parallel with each other, said contact elements further having each a mounting end portion adapted for being located in the interior of said housing and a central region adjacent said mounting portion and having a step-like bend therein, said bend being of a height amounting to approximately half the height of the interior space, said height of said interior space being the shortest distance between opposite sidewalls in said housing, the bend of each of said contact elements being such that said mounting end portions rest between, and in contact with, two opposite ones of said internal surfaces of said housing sidewalls;

(e) a bimetal snap disc having a fastening end and an opposite slewable end and extending between said fastening end and said slewable end thereof in a direction transverse to the direction of longitudinal displacement of said push button, said bimetal snap disc being fastened with said fastening end thereof to the mounting portion of said first contact element;

said slewable end of said bimetal snap disc overlapping said mounting end portion of said second contact element, and being urged by said pressure spring into contact with said lastmentioned mounting end portion, when the circuit breaker is in unactuated closed position;

said push button comprising (f) an innermost end located inside said housing and (g) a separating wall protruding laterally on one side from the region of said innermost push button end and having a rim portion turned toward said push button;

said bimetal snap disc having a lateral projection, said rim portion of said separating wall adapted for engaging said lateral projection of said disc with bias applied thereto by said pressure spring, when said bimetal snap disc is in nonexcited state; and (h) contactor means on said second contact element, said separating wall being adapted for introduction between said slewable end of said bimetal snap disc and said second contact element contactor means with bias applied thereto by said pressure spring, when said bimetal snap disc is in excited, upwardly bent state.

2. The circuit breaker of claim 1, wherein said housing comprises two at least substantially identical half shells of substantially U-shaped cross section.

3. The circuit breaker of claim 1, wherein said contact elements consist of identical punched and bent parts.

4. The circuit breaker of claim 1, wherein the breadth of the bimetal snap disc in the direction of longitudinal displacement of said push button corresponds at least approximately the length thereof in a direction transverse to said direction of longitudinal push button displacement.

5. The circuit breaker of claim 1, wherein said separating wall is substantially L-shaped, comprising a first and a second L-leg.

6. The circuit breaker of claim 5, wherein said pressure spring comprises a guiding pin extending thereinto, and said first L-leg extends substantially parallel with, and said second L-leg extends substantially at right angle, said guiding pin.

7. The circuit breaker of claim 1, wherein said push button has a central portion and an actuating end portion adapted for protruding out of said casing, and a groove extending transversely in said actuating end portion and being open toward said central portion of said push button; and said bimetal snap disc having an upper rim portion adapted for engaging said groove when the push button is depressed, whereby the depressed push button considerably overlaps with said bimetal snap disc.

8. The circuit breaker of claim 2, wherein at least one of said half shells of said housing has a longitudinally extending groove in which said pressure spring is guidingly lodged.

9. The circuit breaker of claim 2, wherein at least one of said half shells has recesses for receiving said mounting end portions of said contact elements therein.

10. The circuit breaker of claim 9, wherein said housing comprises a segment extending over at least a portion of said prong-shaped ends of said contact elements, said segment having recesses for receiving said portion of said prong-shaped ends therein.

11. The circuit breaker of claim 2, wherein at least one of said half shells comprises a shell segment and assembling pins protruding from said segment; and said prong-shaped ends of said contact elements have round holes adapted for receiving said assembling pins therein.

12. The circuit breaker of claim 10, wherein said two half shells comprise each a segment and two pairs of spring-biassed hooks mounted therein, said hooks having backsides facing toward each other at a distance adapted for permitting resilient slewing movement of each hook of one pair toward and away from the opposite hook of the other pair.

13. The circuit breaker of claim 1, wherein said pressure spring comprises a stiffening element made of insulating material and having the shape of an elongated plate having a flat face turned toward said push button and being adapted for supporting one end of said pressure spring thereon, said stiffening element extending transversely to the direction of push button displacement, and having opposite rim portions adapted for coming to rest on the underside and the upper side, respectively, of said two contact elements in the region of said bends thereof.

14. The circuit breaker of claim 13, wherein each of said rim portions has a cutaway section located diagonally opposite the other one, and each cutaway section being adapted for fitting on to the underside and the upperside, respectively, of said contact elements.

* * * * *